US007239276B1

(12) United States Patent
Bonanni

(10) Patent No.: US 7,239,276 B1
(45) Date of Patent: Jul. 3, 2007

(54) METHOD AND SYSTEM FOR FAST SYNTHESIS OF SHAPED PHASED-ARRAY BEAMS

(75) Inventor: Pierino Bonanni, Clifton Park, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 41 days.

(21) Appl. No.: 11/256,076

(22) Filed: Oct. 24, 2005

(51) Int. Cl.
*H01Q 3/01* (2006.01)

(52) U.S. Cl. ..... 342/377; 342/372

(58) Field of Classification Search ..... 342/368, 342/372, 373, 377; 365/230.1; 708/816, 708/819

See application file for complete search history.

(56) References Cited

U.S. PATENT DOCUMENTS 6,343,307 B1 * 1/2002 Mendlovic et al. ..... 708/819
6,522,897 B1 * 2/2003 Martek et al. ..... 455/562.1
2005/0232057 A1 * 10/2005 Hansen et al. ..... 365/230.01

* cited by examiner

*Primary Examiner*—Dao Phan
(74) *Attorney, Agent, or Firm*—McDermott Will & Emery LLP

(57) ABSTRACT

Calculating the phase shifts assigned to the elements of a phased array antenna such that the resulting beam is shaped to serve a desired area of operation (AOO) has historically been computationally burdensome and often required expert intervention. To maximize computational speed, synthesis of shaped phased-array antenna beams is performed by linearizing the antenna pattern equation and then iteratively performing a mini-norm solution at each step until a solution is reached. In particular, this approach is performed in such a manner that eliminates the need for a pre-computed target and is also performed such that at each iteration the change in an element's phase is adapted to remain within a threshold range. As a result, phased array beam patterns may be synthesized and applied to phased-array antennas so as to allow real time tracking of AOOs on the Earth from Low and Medium Earth Orbit satellites.

33 Claims, 6 Drawing Sheets

600

650

METHOD AND SYSTEM FOR FAST SYNTHESIS OF SHAPED PHASED-ARRAY BEAMS

STATEMENT AS TO RIGHTS TO INVENTIONS MADE UNDER FEDERALLY SPONSORED RESEARCH OR DEVELOPMENT

Not applicable.

FIELD OF THE INVENTION

This present disclosure relates generally to satellite antenna systems. More specifically, this disclosure relates to beam-shaping synthesis in phased array antenna systems.

BACKGROUND OF THE INVENTION

There are a number of applications in which it is desirable to maintain specific beam patterns in satellite-based phased array antennas. For example, in a variety of satellite communications and ranging applications, including various global-positioning-system ("GPS") applications, it is desirable to maintain a fixed "footprint" on the terrestrial surface, a term sometimes used in the art to refer to the pattern of the beam on the surface. Maintaining a fixed footprint is generally straightforward in cases where the satellite is in a geostationary orbit, but it may be difficult to maintain a fixed footprint in cases where the satellite is in a nongeostationary or elliptical orbit. In such cases, the footprint naturally tends to move over the terrestrial surface as the elevation of the satellite changes, the terrestrial motion of the footprint being a reflection of the spatial orbital motion of the satellite relative to the terrestrial body. Continuous beam shaping is required to maintain a fixed footprint.

The difficulty in maintaining a fixed footprint for satellites in nongeostationary orbits may also be complicated by imposition of a variety of performance criteria. For example, the satellite may be required to provide beams that meet certain power and phase characteristics, particularly in placing limits on sidelobe power outside of a defined service region and transition region. A number of efforts to provide fixed footprints with satellite systems can be commonly characterized by the fact that they are limited to only certain predetermined beam shapes and sizes, such as for fixed-radius circles. These limitations greatly reduce the flexibility that is desired, particularly for applications that may specify a service region having a unique shape and size. Considering the speed at which satellites may travel relative to the Earth, especially in low and mid-Earth orbits, accurately computing a beam pattern for a phased-array antenna that will maintain the desired footprint has proven difficult.

There are currently techniques for synthesizing phased array beam patterns in applications where the desired beam shape does not change significantly in a matter of minutes or even seconds. These techniques, however, are not useful in synthesizing beam patterns in real time or near real time because the computational algorithms they use are too slow and often take tens of minutes to hours to arrive at a solution. One alternative approach to more quickly synthesize phased-array shaped beams has been described in a pending patent application entitled FIXED FOOTPRINT IN NON-GEOSTATIONARY SATELLITES by Khalil J. Maalouf et al. filed on Apr. 1, 2004, application Ser. No. 10/816,692, the disclosure of which is incorporated by reference in its entirety. The approach of Maalouf et al., in general terms, relies on iteratively calculating a mini-norm solution to a Taylor series expansion of the conventional far-field gain equations. While effective in many situations, improving the accuracy, convergence and robustness of the approach of Maalouf et al. will only expand the applicability of this type of approach to synthesizing beam patterns in a wider variety of situations.

There is accordingly a general need in the art for improved methods and systems that robustly and accurately provide quick synthesis of shaped phased array antenna beams.

SUMMARY

Fast synthesis of phased array antenna beam patterns will allow non-geostationary based antennas in a variety of different orbits to provide accurately controlled fixed footprint coverage to almost any area of the Earth. Accordingly, aspects of the present invention relate to performing fast synthesis of phased array antenna patterns via a computer program and a system to execute such a program, wherein this system may be ground based or based on a satellite or spacecraft. As a result, phased array beam patterns may be synthesized and applied to phased array antennas so as to allow real time tracking of areas of operation on the Earth from low and medium Earth-orbit satellites.

One aspect of the present invention relates to fast synthesis of phased array antenna beam patterns that is adaptive in nature. In particular, a gain equation for the antenna is solved for in an iterative manner in which, for each iteration, a change of phase is calculated for the phased array antenna. For example, a delta phase value can be calculated for each element of the array. Instead of simply using the calculated phase change, it is tested to determine the magnitude of change. Depending on the magnitude of phase change, it may be used or it may be adjusted. In this way, the phase change implemented at each iteration is dynamically adapted.

Another aspect of the present invention relates to fast synthesis of phased array antenna beam patterns that works even in the absence of a pre-computed target. Synthesis without a pre-computed target eliminates the need for an expert's input to the synthesis and eliminates the potential of introducing an error if the pre-computed target is flawed in some way. Accordingly, the gain equation for an antenna is solved in an iterative fashion in which a proposed change in gain at each iteration is not dependent on some pre-computed target. Instead, the proposed change in gain is calculated based on adjusting the gain values of associated control points without relying on a pre-computed target.

DETAILED DESCRIPTION

Figure 1:
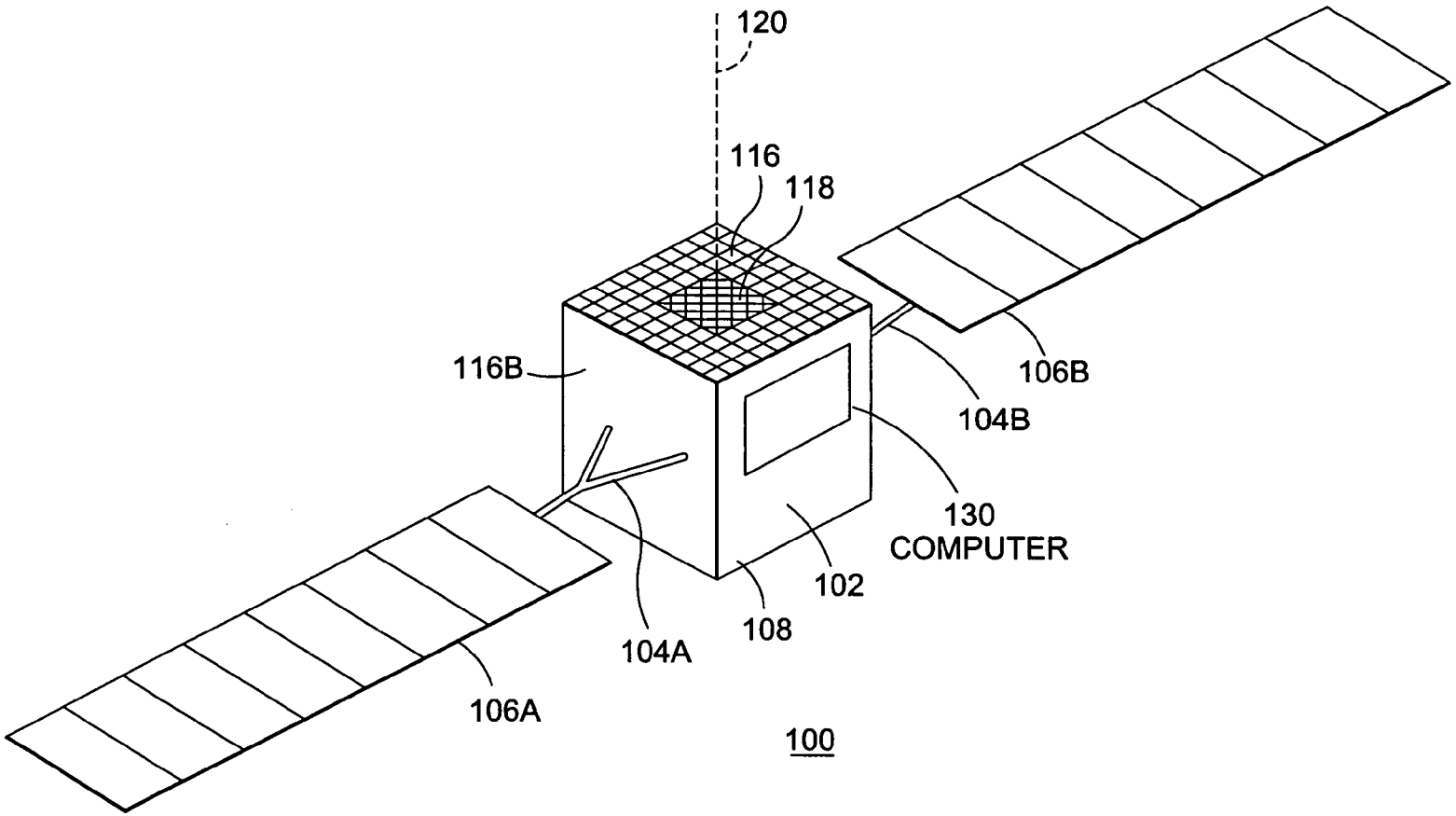
FIG. 1 illustrates an exemplary space-craft or satellite that supports a phased-array antenna.

There are numerous satellite and antenna configurations that may be used in combination with embodiments of the invention, one example of which is illustrated In FIG. 1. Still other examples of suitable satellite and antenna configurations are provided in the following copending applications, each of which is incorporated herein by reference in its entirety for all purposes: U.S. patent application Ser. No. 10/442,015, entitled "CONCENTRIC PHASED ARRAY SYMMETRICALLY ORIENTED ON THE SPACECRAFT BUS FOR YAW-INDEPENDENT NAVIGATION," filed May 19, 2003, by Anthony W. Jacomb-Hood and Erik Lier and U.S. patent application Ser. No. 10/625,810, entitled "PARTLY INTERLEAVED PHASED ARRAYS WITH DIFFERENT ANTENNA ELEMENTS IN CENTRAL AND OUTER REGION," filed Jul. 11, 2003, by Erik Lier and Anthony W. Jacomb-Hood. The identification of these specific satellite and antenna configurations is not intended to be limiting and other configurations that may be used will be evident to those of skill in the art after reading this description.

In the exemplary embodiment of FIG. 1, a spacecraft is provided with a spacecraft-based antenna. The spacecraft 100 includes a spacecraft body or bus 102, from which solar panels 106A and 106B are deployed with support members 104A and 104B. The solar panels 106A and 106B are used to produce electrical energy for powering the spacecraft, with energy being stored during periods of excess energy in a battery or other storage device to accommodate peak loads and those intervals when the solar panels 106A and 106B may be in shadow. Mounted on the spacecraft bus 102 is antenna 116, which is typically centered symmetrically about a yaw axis of rotation 120 of the spacecraft 100. The spacecraft 100 may also include other antennas, such as deployed antennas, which are not shown in FIG. 1. Also, a computer system 130 may also be on-board the spacecraft, or satellite, 100. Even without explicitly describing the control and operation of the phased-array antenna 116, one of ordinary skill will recognize that the antenna 116 may be one of the many different types and configurations of phased-array antennas that are known in this field.

According to embodiments of the invention, a shaped beam from the antenna 116 may be modified substantially continuously in real time to maintain fixed coverage over a defined service region, or area of operation, even as the satellite moves relative to the terrestrial body. While embodiments of the invention are not limited to any particular shape for the service region, consideration of a substantially circular region illustrates how the beam shape may be modified. When the satellite is at nadir, the shape of the service region as seen by the satellite is substantially circular, but takes on an elliptical shape at different elevations, with the eccentricity of the ellipse increasing as elevations are lowered.

In general, a phased-array antenna, such as the one aboard a satellite 100 includes n elements arranged in a particular pattern. This pattern may be rectangular, square, circular, oval or some other more complex shape. As is known in the art, the elements of the antenna are electronically controlled such that a desired far field voltage gain pattern is observed at various points distant from the antenna. In practice, the energy fed to each element to be radiated is controlled in both phase and amplitude to steer and shape the gain pattern in a desired manner. The resulting electromagnetic energy radiated from each antenna element constructively and destructively interferes with energy radiated from the other antenna elements to create a gain pattern that varies as desired in different directions.

The gains applied to the respective antenna elements are complex-valued, having both amplitude and phase components. Often, the amplitude for each element is controlled in a predetermined manner while a calculated phase change is introduced at particular elements to re-shape the resulting antenna beam in a desired pattern.

Figure 3:
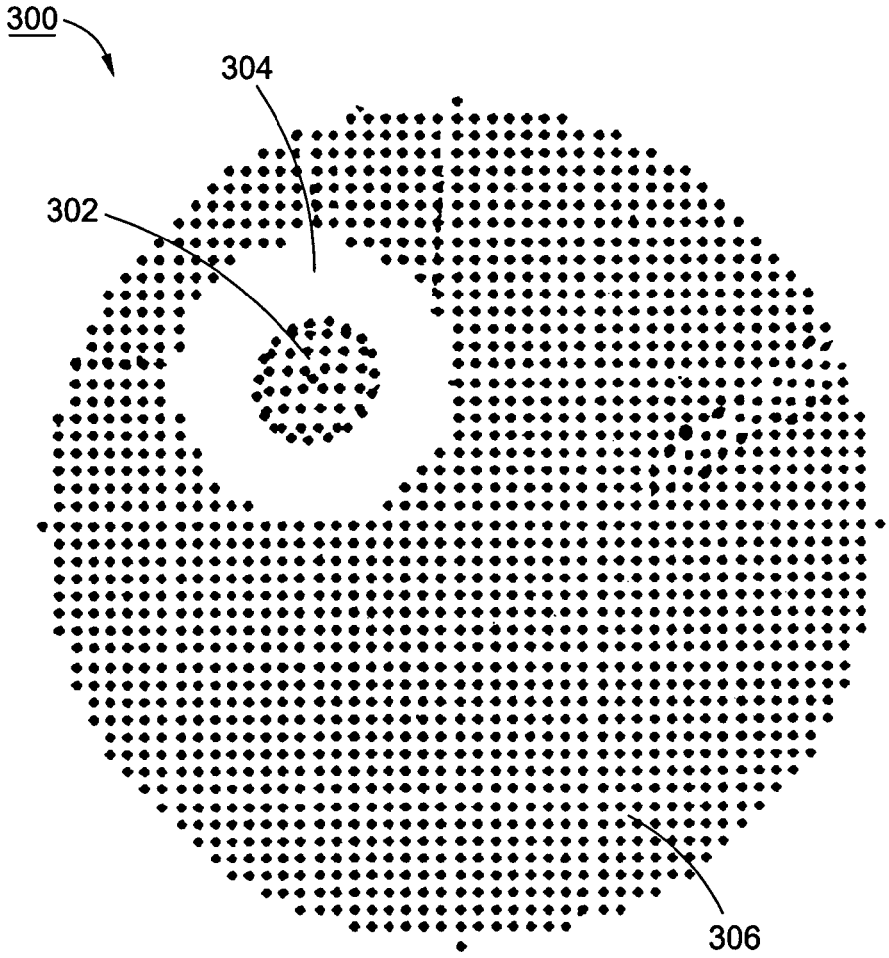
FIG. 3 depicts an exemplary grid pattern for which a beam pattern is synthesized in accordance with the principles of the present invention.

It is conventional to refer to this gain pattern in terms of a two-dimensional direction vector which uses the center of the antenna's element pattern as a point of reference. Using the particular example of the Earth, as shown in FIG. 3, the gain pattern can be thought of as a number of locations laid out in a grid. As known to one of ordinary skill, the spacing of the grid points is a function of the physical size of the antenna array wherein a larger array requires more grid points (finer resolution) and a smaller array requires fewer grid points (coarser resolution). While, embodiments of the present invention are useful with a variety of different grid resolutions, one exemplary grid may contain approximately 64×64, or more, locations.

Using conventional definitions known to one of ordinary skill in this field, $[T_x^m, T_y^m]$ denotes the x and y components of a unit vector from the antenna to a location, m, on the grid (i.e., the $m^{th}$ spatial direction). For an antenna with N elements, the far field voltage gain in the $m^{th}$ spatial direction is approximated as $$g(Tx^m, Ty^m) = \sum_{n=1}^{N} E(Tx^m, Ty^m) A_n e^{-j\theta_n} e^{j\frac{2\pi}{\lambda}[x_n Tx^m + y_n Ty^m]} \tag{1}$$

where $A_n$ are the element amplitudes, $\theta_n$ are the applied element phases, $\lambda$ is the antenna's operating wavelength and $E(T_x^m, T_y^m)$ is the element pattern gain in the $m^{th}$ direction.

By defining a kernel $K_{mn}$ that collects together the portions of equation (1) that depend on direction, that equation can be re-written in matrix format as:

$$[g_m]=[K_{mn}][A_n e^{-j\theta_n}] \tag{2}$$

where $g_m$ is a shorthand for $g(T_x^m, T_y^m)$ and where the left-hand side of equation (2) is an (m×1) matrix and the right-hand side is an (m×n) matrix multiplied by an (n×1) matrix.

Thus, when desiring to generate a particular far-field gain pattern, equation (2) is typically solved for $\theta_n$. However, calculating solutions for equation (2) is not a straightforward problem because the right-side of the equation is nonlinear with respect to $\theta_n$. Thus, as mentioned earlier in the Background section, there have been conventional approaches to solving equation (2) using various mathematical techniques useful for this type of equation which have provided unsatisfactory performance.

One particular approach that is described in more detail in the previously mentioned and incorporated patent application applies a mini-norm strategy to solving equation (2). Because embodiments of the present invention utilize some aspects of this mini-norm approach, it will be briefly discussed. However, many of the details of that earlier mini-norm strategy are omitted so as not to obscure the present invention.

In general, the mini-norm strategy begins by linearizing the problem. This is accomplished by making the approximation that for small changes in gain values, the dependence on $\theta_n$ is linear in nature. Mathematically, this approximation is captured by the equation:

$$\Delta g(Tx^m, Ty^m) = \sum_{n=1}^{N} \frac{\partial(g(Tx^m, Ty^m))}{\partial \theta_n} * \Delta\theta_n \tag{3}$$

and after computing partial derivatives, equation (3) is written in matrix form as:

$$[\Delta g_m] = [-je^{-j\theta n} K_{mn}][\Delta\theta_n] \tag{4}$$

Equation (4) is more concisely written as $$\Delta g = C\Delta p \tag{5}$$

wherein each component of this equation is an appropriately sized matrix. Wherein the Δp vector is an (n×1) vector having a $\Delta\theta_n$ value for each of the n elements of the phased-array antenna. Noting that Δg and C are complex-valued, equation (5) can be arranged by separating real and imaginary parts such that $$\begin{pmatrix} \mathrm{Re}\{\Delta g\} \\ \mathrm{Im}\{\Delta g\} \end{pmatrix} = \begin{pmatrix} \mathrm{Re}\{C\} \\ \mathrm{Im}\{C\} \end{pmatrix} \Delta p \tag{6}$$

Doing so results in a strictly real system of equations that ensures real-valued solutions for Δp. Using known matrix manipulation techniques, the pseudo inverse of C is calculated in order to write Equation (6) as:

$$\Delta p = \begin{pmatrix} \mathrm{Re}\{C\} \\ \mathrm{Im}\{C\} \end{pmatrix}^{+} \begin{pmatrix} \mathrm{Re}\{\Delta g\} \\ \mathrm{Im}\{\Delta g\} \end{pmatrix} \tag{7}$$

This equation expresses the minimum-norm solution (often referred to as "mini-norm") to the underconstrained system represented in equation (6). Recognizing that equation (7) can be solved for Δp allows it to be used in a synthesis algorithm for computing phase values to apply to the different elements of the phased-array antenna. The above described treatment of the phased-array elements and the resulting gain pattern assume that only the phase, and not the amplitude, is changed for each element of the antenna array.

Figure 2:
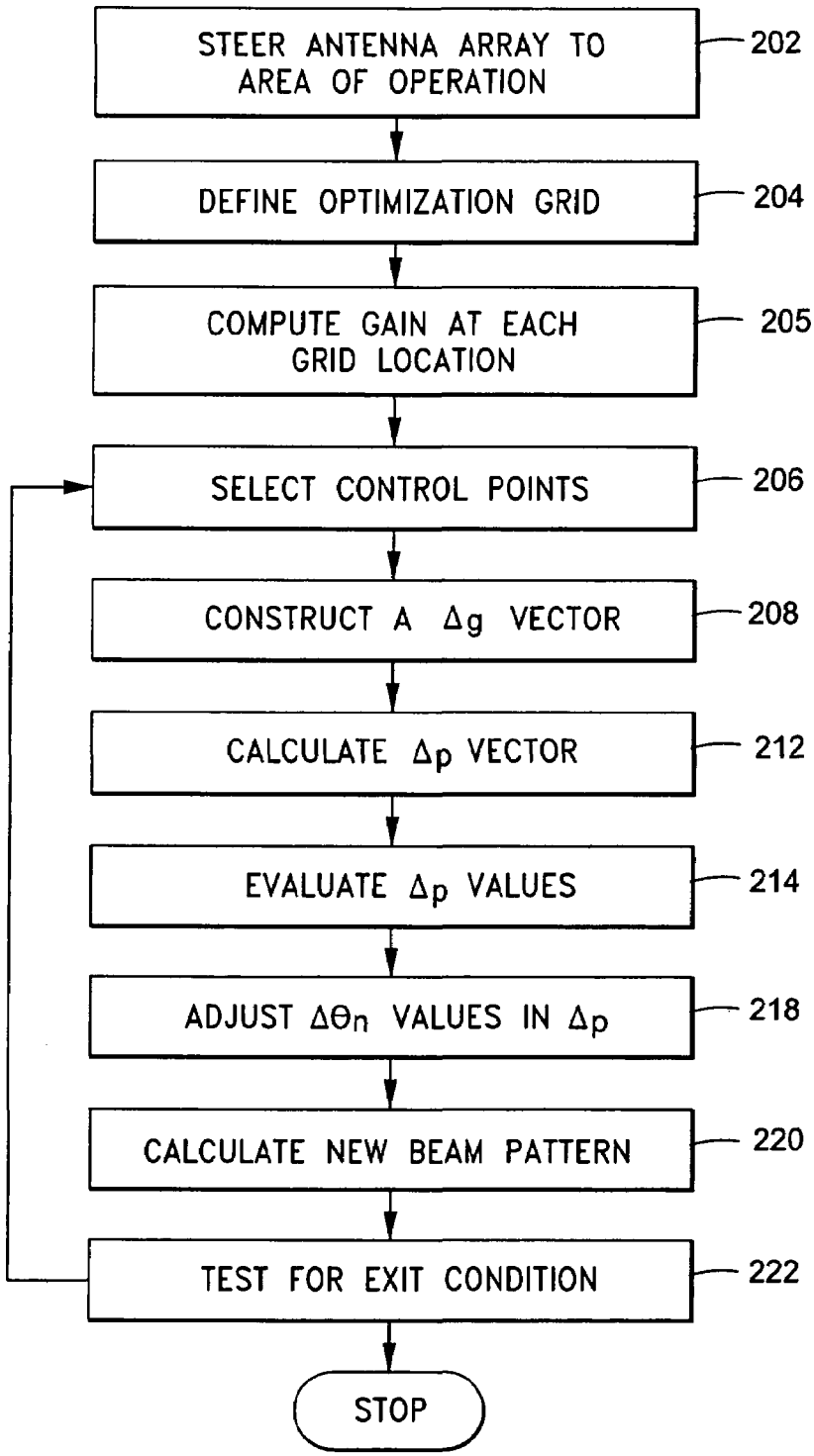
FIG. 2 depicts a flowchart of an exemplary method for synthesizing beam patterns in accordance with the principles of the present invention.

FIG. 2 depicts a flowchart of the steps in an exemplary method for synthesizing shaped beams for a phased-array antenna in accordance with the principles of the present invention. The result of the synthesis may be used with any type of phased-array antenna regardless of the specific manner in which the antenna electronically adjusts the phase control for each array element. In step 202, the phased-array elements are controlled so as to steer the array to an area of operation (AOO). According to well-recognized techniques, the phase value at each element are controlled such that a natural (or un-shaped) beam is steered towards a particular center point of the AOO. Step 202 merely accomplishes setting an initial phase value for each element that will later be refined. Accordingly, other approaches for initializing the phase values for each element are contemplated as well, which provide a coarse approximation of the ultimately-desired beam shape.

Next, in step 204, a grid is super-imposed over the target area. In this particular example, the AOO is a generally circular, or oval, pattern on the Earth and, thus, a similarly shaped grid is defined on the Earth's surface. Referring to FIG. 3, locations on the grid 300 can be categorized into a boost region 302, a transition region 304, and a sidelobe region 306. The boost region 302 correlates to the AOO, while the sidelobe region 306 describes the other portions of the Earth's surface. There is a transition region 304 around the periphery of the boost region 302 that transitions from the boost region 302 to the sidelobe region 306. The size of the transition area 304 is dictated by the antenna array size (physical dimensions), such that a larger antenna array allows a smaller transition area and a smaller antenna array results in a larger transition area. In general terms, the boost region 302 is where the gain pattern should have the highest values and the sidelobe region 306 is where the gain pattern should have the lowest values. One commonly used metric of performance is known as the "offset" which can be calculated in different ways. One method is to subtract the highest sidelobe region gain value from the lowest boost region gain value. The larger this difference, the better the antenna performance. Another common way to calculate offset is to measure the lowest boost region gain value relative to zero. Other performance measurements may use averages of various values and other statistical techniques as well.

The far-field voltage gain at each grid location is one of the ways that an antenna beam may be characterized. Thus, the elements of the antenna are controlled to produce a particular desired gain value at each element of the grid. As understood by one of ordinary skill, there are inherent limitations to the resolution at which the gain value may be affected because of the antenna's operating wavelength and antenna size. For example, it is convenient to ignore the transition region 304 of FIG. 3 when synthesizing patterns for a phased array antenna because attempts to constrain values within this region are counter-productive to reaching a solution.

As known to one of ordinary skill, a boost region 302 may be characterized by parameters that specify its size, shape, and location in the field of view of the antenna. The sidelobe region 306 may be characterized by similar parameters.

Given the initial steering of the antenna beam accomplished in step 202, the gain at each grid location can be determined, in step 205, according to equation (2). This initial gain pattern is likely to be a low performing pattern. Therefore, the goal is to use equation (7) to compute phase change values for each element of the antenna so as to reach a performance metric (e.g., maximize the offset) for the resulting beam pattern. In many practical instances, the Δg vector of equation (7) has hundreds, possibly thousands, of rows (i.e., one for each grid location) and the Δp vector has many rows as well (one for each antenna element). Additionally, to preserve the applicability of the mini-norm approach, the choices for Δg are constrained in their magnitude so as to preserve the assumption that its behavior remains linear with respect to a change in phase. Accordingly, equation (7) is solved in a careful manner. More particularly, in step 206, a limited number of control points are selected from the grid 300. One particular embodiment described in more detail herein, selects six control points from the grid 300. One of ordinary skill will readily recognize, however, that fewer or more control points may be selected as well without departing from the scope of the present invention. However, during validation experiments related to the presently described method, six control points offered a desirable compromise between accuracy, robustness, and efficiency of computation.

The control points selected in step 206 are not necessarily picked at random. In contrast, picking them intelligently by picking the worst performing points on the grid provides better results. In particular, in the example in which six control points are used, the two worst performing (i.e., lowest gain value) locations in the boost region 302 and the four worst performing (i.e., highest gain value) locations in the sidelobe region 306 are selected as the six control points. Again, selecting six points is merely provided as a concrete example and other numbers of control points are contemplated as well.

A brief discussion of one previous iterative approach, such as that described in the previously incorporated Maalouf et al. patent application, may be helpful to accentuate certain aspects of the exemplary flowchart of FIG. 2. This discussion highlights only certain aspects of the previous patent application and is not intended to, and should not be interpreted so as to, completely describe all features and aspects of that invention described therein. According to such a previous approach, an expert was typically consulted to pre-compute target values that the synthesis should be able to achieve. Such computation relied on the expert's knowledge of the boost region's location on the Earth, the boost region's size, and the characteristics and capabilities of an antenna. For example, the pre-computed target values might include a prediction of the highest gain value possible within the boost region and the lowest gain value possible within the sidelobe region. With these pre-computed target values in place, the control points could be adjusted accordingly. For example, if the pre-computed target value in the boost region was 80 and the worst performing boost point was 50, then the difference of 30 (or some predefined fraction thereof) would be used to adjust the gains. A similar difference could be calculated and used for each control point. Remembering that changes of gain should be relatively small to preserve the assumption of linearity, the difference may be scaled down (for example by 90%) to calculate a change in gain, Δg, for each control point. Thus, a difference of 30 would result in a Δg at that control point of "3". For boost region control points, the Δg value is positive and for sidelobe region control points, the Δg value is negative. The Δg vector, of equation (7), is then constructed with the six computed change-in-gains at each control point and zero at all other points. Ultimately, the Δp vector is solved for and the process can repeat.

In contrast to the techniques just described, the exemplary method depicted in the flowchart of FIG. 2, does not rely on pre-computed target values and, thus, eliminates reliance on an expert in synthesizing phased array antenna beams. Furthermore, instances may occur where a pre-computed target value may be flawed which might adversely affect the finding of a solution. For example, too aggressive a target may cause non-convergence of a solution while too timid a target value may result in a less than optimal pattern. Accordingly, eliminating reliance on a pre-computed target value improves the likelihood of converging toward an optimal synthesis solution for the phased-array beam pattern.

In step 208, the six control points are used to construct a vector (i.e., Δg) to use in solving equation (7). In particular, the six control points are complex-valued and, therefore, reside in a 12-dimensional space comprising the points which, in turn, correspond to the real and imaginary components used in the computation. In an example where more control points are used, for example, eight control points, a 16-dimensional space would be defined. As just mentioned, the gain value of each of these control points is complex-valued having real and imaginary components and each control point can be conceptualized as a vector in the two-dimensional complex plane traveling away from the origin. Increasing the magnitude but not the phase is analogous to traveling away from the origin in a constant direction and decreasing the magnitude without changing the phase is analogous to traveling towards the origin. Accordingly, respective deltas, or changes are computed for each of the six control points. In one embodiment described herein, the deltas are computed so as to meet three criteria:

a) the phase of each boost control point remains substantially unchanged, b) the total of all the magnitude deltas sums to substantially zero, and c) they are relatively small so as to preserve the assumption of linearity with respect to changes in phase.

One of ordinary skill will recognize that there are a wide variety of ways to satisfy these criteria. For example, the respective deltas for the two boost region control points should be positive-valued because the goal is to increase the gain at these two points. The respective deltas for each of the four sidelobe region control points should be negative valued because the goal is to decrease the gain at these four points. Accordingly, one possible approach would be to have a delta of (+2) for each boost region control point and a delta of (−1) for each sidelobe region control point. These six deltas would sum to zero which, in other words, means applying the deltas would not result in increasing the overall gain in the resulting beam pattern.

Other alternative approaches are also contemplated. For example, the following algorithmic approach may be used to construct the Δg vector:

$$\Delta g_i^{boost}=(g_i^{boost}/|g_i^{boost}|) \quad 1)$$

$$\Delta g_i^{sidelobe}=(-0.1)g_i^{sidelobe} \quad 2)$$

$$\text{Total}=\Sigma|\Delta g_i^{sidelobe}| \quad 3)$$

$$\text{Scale}=(\text{Total}/(\text{number of boost control points}) \quad 4)$$

$$\Delta g_i^{boost}=(\text{Scale})(\Delta g_i^{boost}) \quad 5)$$

First, as a preliminary matter a Δg value for each boost control point is computed having a magnitude of "1" but retaining the phase of the original gain value of that boost control point. Next, each of the sidelobe gain values are scaled down by a predetermined factor to calculate a respective Δg value for each of the sidelobe control points. One advantageous factor, for example, may be (−0.1). Steps 3 and 4 compute a scaling factor that totals the entire negative effect caused by the sidelobe Δg values and distributes it across all the boost Δg values. Finally, in step 5, the scaling factor is applied to the initial boost Δg values to arrive at the final boost Δg values. Thus, a Δg vector is constructed that represents a direction in a 12 dimensional space.

By using just the 12 values within the Δg vector when solving equation (7), the direction in the 12-dimensional space is transformed, or mapped, into the n-dimensional space of the Δp vector (i.e., the Δp vector is an (n×1) vector having a $\Delta\theta_n$ value for each of the n elements of the phased-array antenna). In other words, a move in a desirable direction in the 12-dimensional space maps into a desirable move in the n-dimensional space of the Δp vector. As described earlier, it is often convenient to separate the real and imaginary components of the different values when manipulating the equations; doing so in this instance results in the Δp vector having 2n-dimensions.

Thus, once the Δg vector is available, equation (7) is used, in step 212, to calculate Δp. Using conventional mini-norm techniques, the underconstrained system results in many possible Δp solutions and the one with the minimum overall phase adjustment is selected as the solution. One of ordinary skill will recognize that instead of merely using mini-norm techniques that other, functionally equivalent, techniques may also be used to solve this system of underconstrained equations.

Caution should be used, however, to move an appropriate amount along the Δg vector direction; moving too great an amount may not allow the assumption of linearity to be maintained, while moving too little is not efficient. Accordingly, in step 214, the values of the Δp vector are evaluated to determine how their magnitudes compare to a predetermined threshold. For example, one or more phase change values (positive or negative) that are relatively large may indicate that too aggressive a move was made along the Δg vector direction. Therefore, based on the comparison of the magnitude of the values in the Δp vector with the predetermined threshold, the values in the Δp vector may be adjusted in step 218. One exemplary predetermined threshold is $\pi/8$. One of ordinary skill will appreciate that the predetermined threshold limit may be applied in a number of functionally equivalent ways. For example, there may be a more relaxed limit such that if more than x of the Δp values exceed the predetermined threshold, then the Δp values are adjusted; or alternatively, if the average of the Δp values exceed a predetermined threshold, then the Δp values are adjusted etc.

The determination of step 214 utilizes one or more of the phase change values in the Δp vector to determine whether to reduce or to increase the move that was made along the Δg vector direction. If the move was too little, then each of the values of the Δp vector can be increased; or, if the move was too great, then each of the values of the Δp vector may be decreased. One exemplary method of increasing or decreasing these values involves applying a multiplicative adjustment factor to the values of the Δp vector. For example, this adjustment factor may advantageously be a ratio of the threshold value to the largest magnitude value in the Δp vector. Thus, this ratio is less than one (having a decreasing effect) when the largest Δp value exceeds the threshold and is greater than one (having an increasing effect) when the largest Δp value is less than the threshold. Other functionally equivalent methods of generating an adjustment factor are contemplated as well. Regardless, of the manner in which the adjustment factor is computed, this factor is applied to adjust each $\Delta\theta_n$ of the Δp vector in step 218. Accordingly, the steps described so far implement an adaptive approach to calculating prospective phase changes at each iteration. In practice, this behavior results in an algorithmic approach that more easily and more likely converges on a solution.

The calculated Δp vector represents the change in phase to apply to each of the n elements of the antenna array. Accordingly, the $\Delta\theta_n$ values in the Δp vector are used to adjust the values of $\theta_n$ in equation (2) which describes the far field voltage gain of the phased-array antenna beam. In step 220, the new phase values are used in equation (2) to calculate the new beam pattern. The new beam pattern should be a small incremental step towards a beam pattern that is better performing than the previous beam pattern. Accordingly, with these newly computed beam pattern gain values for each location on the grid, the process returns to step 206, where six (potentially new) control points are selected for the next iteration.

One of ordinary skill will recognize that there are a number of ways to determine when to stop the process described above. Thus, in step 222, some test is performed to determine if a next iteration should be performed or whether the process should be stopped. For example, the process may be stopped after a maximum number (e.g., 300) of iterations are performed. Alternatively, a performance metric (e.g., offset) may be calculated for each iteration and if there has been no significant change observed in the last x iterations, then the process can be stopped. In the latter example, there may be a minimum number of iterations that should be performed even if no significant changes are observed.

In the iterative mini-norm process just described with reference to FIG. 2, it is possible that the results of one iteration may actually result in a lower performing beam pattern that the previous iteration. Accordingly, the $\theta_n$ values and the associated gain pattern values may be stored for each iteration thereby preserving all the possible $\theta_n$ values. Thus, if the final iteration is not the best performing iteration, then the best performing iteration may be retrieved. For example, there may be a storage area allocated for the best performing $\theta_n$ values and their resulting beam pattern. After each iteration, the storage area is overwritten if the current iteration is better performing than the stored information and is not overwritten if the current iteration is worse performing. When the process is stopped in step 222, this storage area will contain the best performing solution.

Once a solution is reached, then the calculated phase values are applied by the electronic controls of the antenna to shape the beam, as would be known to one of ordinary skill. For antennas having hundreds of elements and grids having thousands of locations, the above-described approach to synthesizing an antenna beam can typically be accomplished in 1 to 3 seconds using a conventional Pentium-class computer. Thus, in real-time a phased-array antenna beam from a spacecraft may be shaped such that it maintains a substantially fixed footprint on the Earth in spite of the spacecraft being in a low or medium orbit and in response to expected or unexpected perturbations in its orbit. More particularly, the synthesis of the antenna beam pattern is accomplished in a target-free and adaptive manner. The approach described herein is target-free because no pre-computed target was generated or used to control how the Δg was created during each iterative step. Thus, no expert knowledge was necessary to begin the synthesis and there was no potential for the introduction of an error due to mis-predicting the target. The approach is adaptive because, at each iteration, Δp is analyzed to determine if its values should be adapted, or changed. Accordingly, the adaptive, target-free approach described herein provides antenna beam synthesis that maximizes computational speed, that eliminates the need for intervention by an expert, and that performs in a robust and stable manner.

Although the flowchart of FIG. 2 was described using an example having only one area of operation, or one boost region, embodiments of the present invention contemplate more than a single boost region. For example, if two boost regions are desired, then additional control points may be selected. In such an example, two control points may be selected for each boost region and four control points may be selected for the sidelobe region which results in a total of eight control points being selected. Alternatively, more control points may be selected for the sidelobe region or the sidelobe control points may be selected based on both their proximity to a boost region as well as their gain values. Accordingly, one of ordinary skill will recognize that the above described iterative process may be extended to accommodate more than a single boost region.

At least portions of the present invention are intended to be implemented on one or more computer systems (such as, for example, see FIG. 1, computer 130). As known to one of ordinary skill in the art, such a computer system typically includes a bus or other communication mechanism for communicating information, and one or more processors coupled with the bus for processing information. The computer system also includes a main memory, such as a random access memory (RAM) or other dynamic storage device, coupled to the bus for storing information and instructions to be executed by the processor. The main memory also may be used for storing temporary variables or other intermediate information during execution of instructions to be executed by the processor. The exemplary computer system may further include a read only memory (ROM) or other static storage device coupled to the bus for storing static information and instructions for the processor. A storage device, such as a magnetic disk or optical disk, is provided and coupled to the bus for storing information and instructions. A computer system, such as the one being described, will also operate with various input and output devices connected thereto.

The computer system operates in response to the one or more processors executing one or more sequences of one or more instructions contained in the main memory. Such instructions may be read into the main memory from another computer-readable medium, such as a storage device. Execution of the sequences of instructions contained in the main memory causes the processor to perform the process steps described herein. In alternative embodiments, hard-wired circuitry may be used in place of or in combination with software instructions to implement the invention. Thus, embodiments of the invention are not limited to any specific combination of hardware circuitry and software.

The term "computer-readable medium" as used herein refers to any medium that participates in providing instructions to the processor for execution. Such a medium may take many forms, including but not limited to, non-volatile media, volatile media, and transmission media. Non-volatile media includes, for example, optical or magnetic disks. Volatile media includes dynamic memory, such as the main memory. Transmission media includes coaxial cables, copper wire and fiber optics, including the wires that comprise the bus. Transmission media can also take the form of acoustic or light waves, such as those generated during radio-wave and infrared data communications.

Common forms of computer-readable media include, for example, a floppy disk, a flexible disk, hard disk, magnetic tape, or any other magnetic medium, a CD-ROM, any other optical medium, punchcards, papertape, any other physical medium with patterns of holes, a RAM, a PROM, and EPROM, a FLASH-EPROM, any other memory chip or cartridge, a carrier wave as described hereinafter, or any other medium from which a computer can read. The computer system can also send messages and receive data, including program code, through one or more networks.

As mentioned, the flowchart steps of FIG. 2 may be performed on a computer system, such as the one just described, in real time. The ability to determine beam adjustments in real time makes it possible in some embodiments for the calculations to be performed in space with a satellite on-board processor. In some embodiments, therefore, the steps outlined in FIG. 2 may be performed by a computer system onboard the antenna satellite, in which case the satellite is equipped with a mechanism for knowing its spatial coordinates and altitude. In other embodiments, the steps may be performed by a ground-based computer system which uploads the determined information to the satellite. In this latter arrangement, the ground system is usually equipped with a mechanism for knowing the spatial coordinates and attitude of the satellite. Embodiments of the invention may also be applied to diverse applications, including communications applications for Internet, digital television, and other such services and including range applications for GPS an similar services.

Figure 4A:
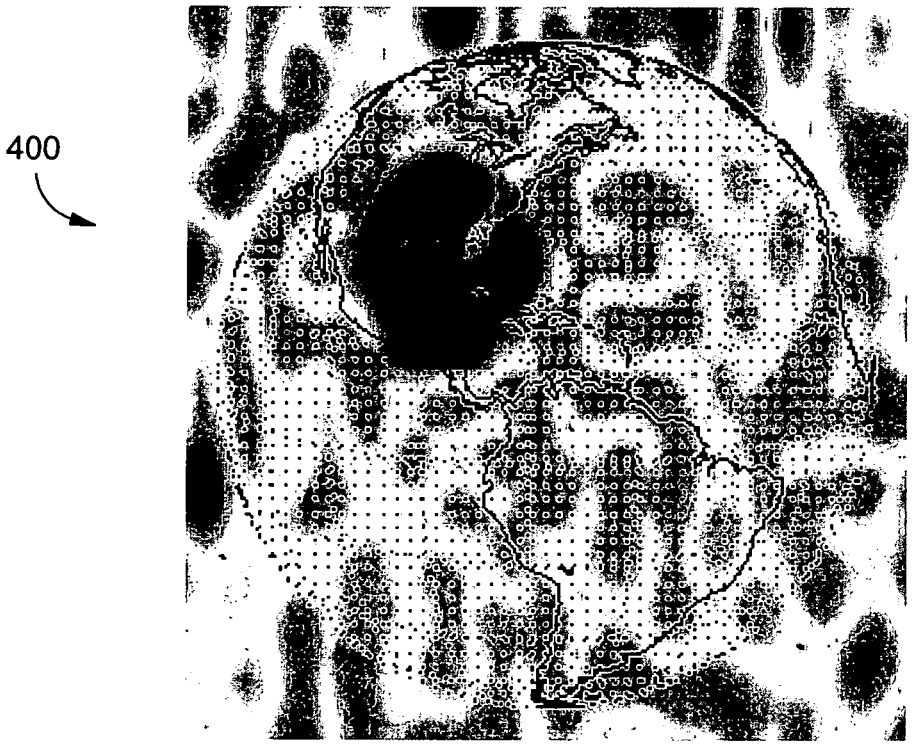
FIGS. 4A and 4B illustrate an exemplary beam pattern synthesized using a pre-computed target.
Figure 4B:
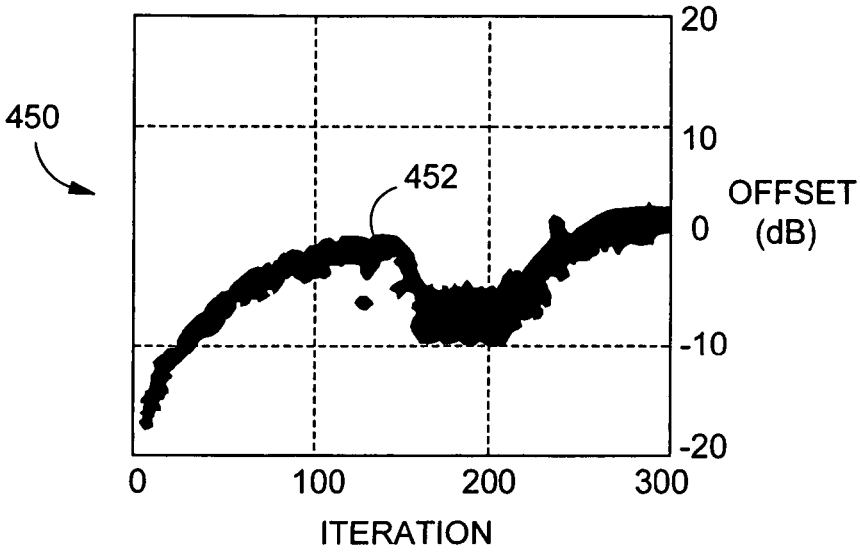

FIGS. 4A and 4B illustrate a beam pattern 400 that was synthesized using a pre-computed target such as that described in the incorporated Maalouf et al. patent application. The pattern 400 shown overlaying the Earth in FIG. 4A is the final pattern synthesized. Although difficult to distinguish in shades of gray, the different gray levels indicate gain at a particular location. What is evident from the pattern 400 is that there is little observed difference between the gain in the boost region and the sidelobe region, often referred to as the "offset". This similarity is shown more clearly in the graph 450 of FIG. 4B. The x-axis of the graph indicates the iteration number of the synthesis and the y-axis represents the offset (measured in dB). The graph 450 indicates that the offset progressively improved over each iteration until a point 452 where it started to worsen; although the offset began to improve again, it ultimately only reached approximately zero.

Figure 5A:
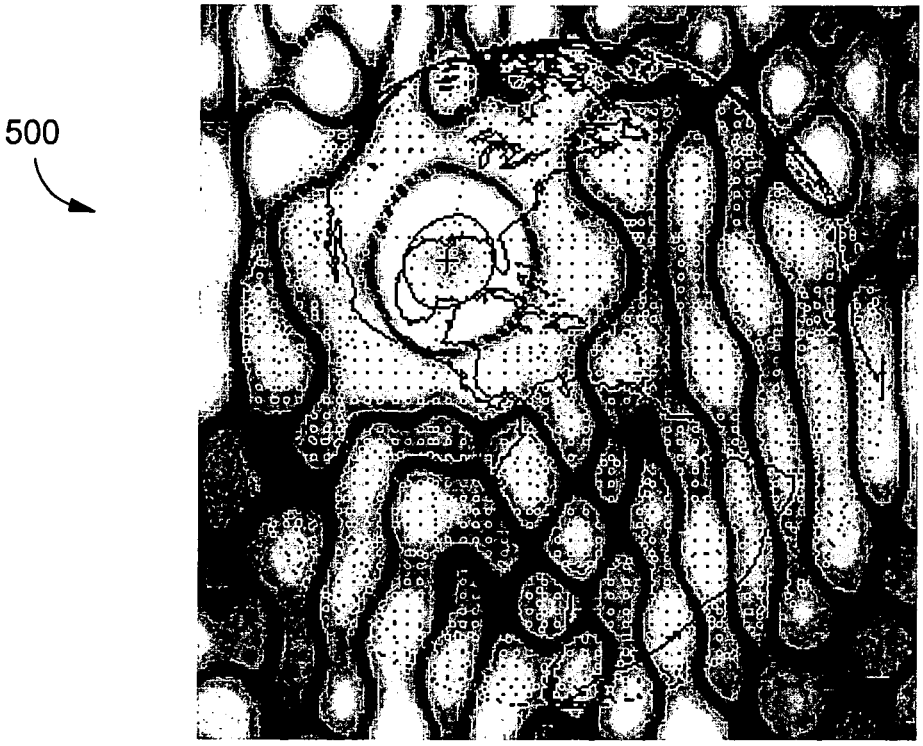
FIGS. 5A and 5B illustrate an exemplary beam pattern synthesized in accordance with the principles of the present invention.
Figure 5B:
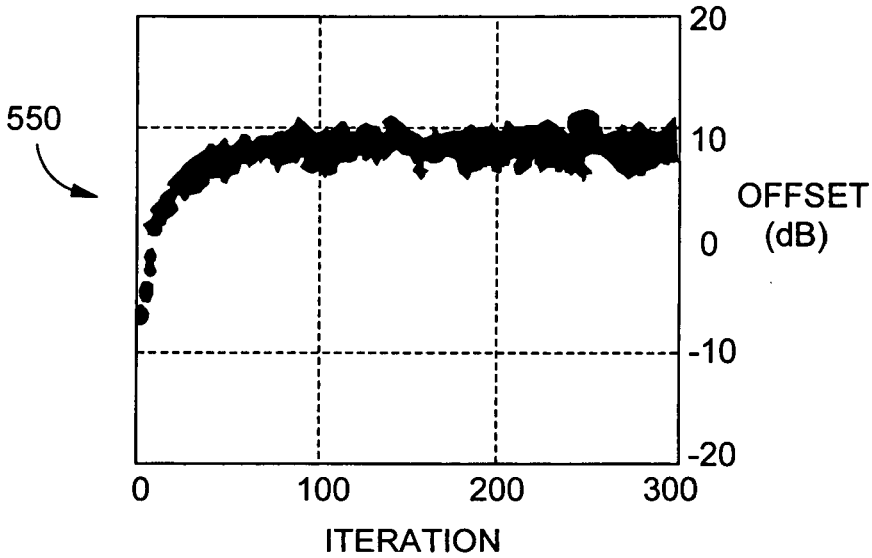

FIGS. 5A and 5B illustrate synthesizing a beam pattern 500 for the same boost region of FIGS. 4A and 4B; however, this synthesis was performed in accordance with the steps depicted in FIG. 2. As can be observed from the graph 550 of FIG. 5B, the offset progressively improves and reaches approximately 10 dB after 300 iterations.

Figure 6A:
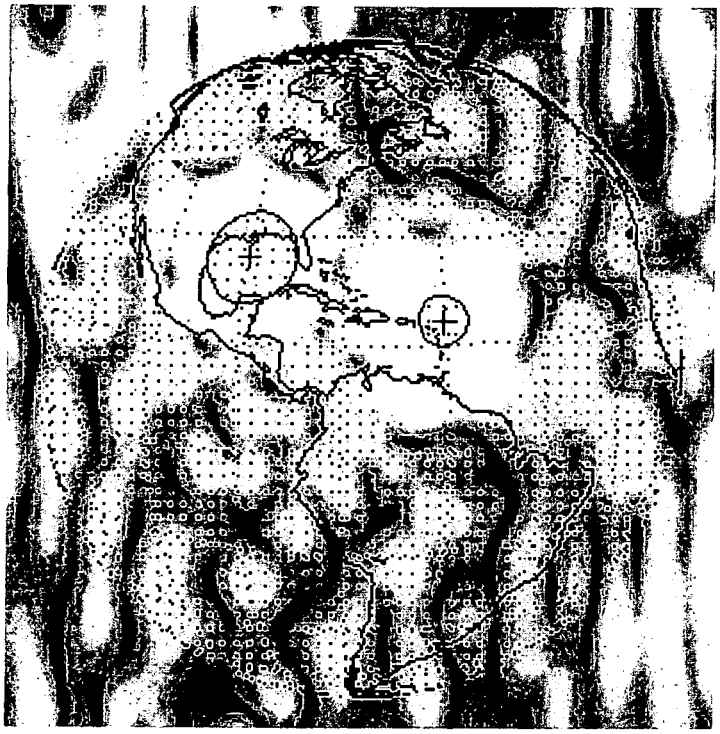
FIGS. 6A and 6B illustrate an exemplary beam pattern having two boost regions synthesized in accordance with the principles of the present invention.
Figure 6B:
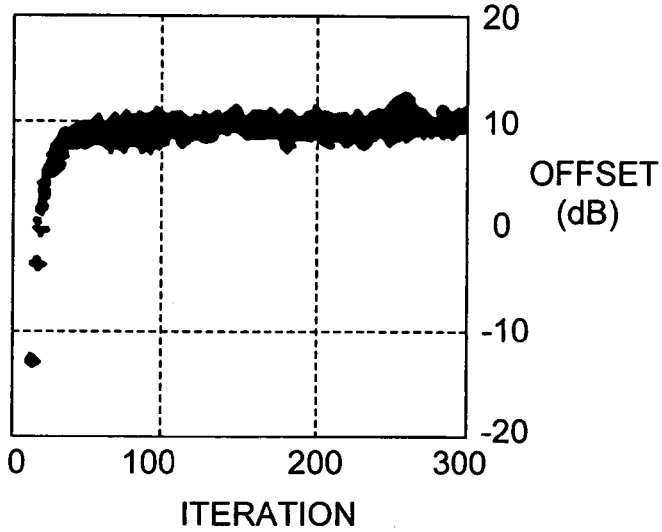

FIGS. 6A and 6B illustrate synthesizing a beam pattern 600 for two separate boost regions in accordance with the principles of the present invention. The graph 650 illustrates that the performance obtained is very acceptable in that the Offset is approximately 10 dB.

The previous description is provided to enable any person skilled in the art to practice the various embodiments described herein. Various modifications to these embodiments will be readily apparent to those skilled in the art, and generic principles defined herein may be applied to other embodiments. Thus, the claims are not intended to be limited to the embodiments shown and described herein, but are to be accorded the full scope consistent with the language of the claims, wherein reference to an element in the singular is not intended to mean "one and only one" unless specifically stated, but rather "one or more". All structural and functional equivalents to the elements of the various embodiments described throughout this disclosure that are known or later come to be known to those of ordinary skill in the art are expressly incorporated herein by reference and intended to be encompassed by the claims. Moreover, nothing disclosed herein is intended to be dedicated to the public regardless of whether such disclosure is explicitly recited in the claims.

What is claimed is:

1. A method of synthesizing a beam for a phased array antenna having a plurality of elements, the method comprising the step of:

solving a gain pattern equation for the phased array antenna for each of a plurality of iterations, wherein for each iteration performing the steps of:

for a current iteration, determining if a magnitude of an initially calculated phase change for the phased array antenna is within a first range;

adjusting the initially calculated phase change for the current iteration to a new phase change value if the magnitude is not within the first range; and using the new phase change value to solve the gain pattern equation for the current iteration.

2. The method of claim 1, wherein the step of solving further includes the steps of:

linearizing the gain pattern equation to form a system of linear equations; and computing a mini-norm solution to the system of linear equations.

3. The method of claim 1, wherein the step of adjusting further includes the step of:

calculating the new phase change value based on the magnitude of the initially calculated phase change.

4. The method of claim 1, wherein the step of determining further includes the steps of:

determining if a respective calculated phase change value for each of the elements of the phased array antenna has a magnitude within the first range.

5. The method of claim 1, further comprising the step of:

for the current iteration, calculating a proposed change in gain for the beam; and based on the proposed change in gain, calculating the initially calculated phase change.

6. The method of claim 5, wherein the step of linearizing the gain pattern equation is performed using a Taylor-series expansion.

7. The method of claim 1, wherein the step of determining if a magnitude of an initially calculated phase change for the phased array antenna is within a first range, further includes the steps:

determining a respective calculated phase change value for each of the elements of the phased array antenna;

identifying a largest magnitude phase change form among the respective calculated phase change values; and determining if the largest magnitude phase change exceeds a predetermined threshold.

8. The method of claim 7, wherein the step of adapting the proposed change in gain further includes the step of:

multiplying the proposed change in gain by the ratio of (the predetermined threshold/the largest magnitude phase change).

9. The method of claim 1, further comprising the step of:

determining if a final solution has been reached.

10. The method of claim 9, wherein the step of determining if a final solution has been reached, further includes the step of:

determining if a maximum number of iterations has been performed.

11. The method of claim 9, wherein the step of determining if a final solution has been reached, further includes the step of:

stopping the solving of the gain pattern equation if a respective solution for the current iteration is substantially the same as a respective solution for a previous iteration.

12. The method of claim 1, further comprising the steps of:

tracking a respective solution to the gain pattern equation for each iteration; and selecting a best performing one of the respective solutions.

13. The method of claim 12, further comprising the step of:

storing the respective solution for the current iteration if it is better performing than the respective solution for each previous iteration.

14. The method of claim 12, wherein performance of a respective solution is measured by its offset value.

15. A method of iteratively synthesizing a beam for a phased array antenna having a plurality of elements, the method comprising the steps of:

a) linearizing a gain pattern equation for the phased array antenna into a system of linear equations;

b) in the absence of a pre-computed target, selecting a proposed gain change for the system of linear equations;

c) based on the proposed gain change, solving the system of linear equations for a resulting phase change;

d) solving the gain pattern equation based on the resulting phase change; and e) repeating steps a)-d) for a plurality of iterations.

16. The method of claim 15, wherein the step of linearizing is accomplished with a Taylor-series expansion.

17. The method of claim 15, wherein the step of solving the system of linear equations for a resulting phase change includes the step of:

calculating, for each element of the phased array antenna, a respective initial phase change value.

18. The method of claim 17, wherein the step of solving the system of linear equations for a resulting phase change further includes the steps of:

determining if any respective magnitude of the initial phase change values for each element is outside of a first range; and adjusting the initial phase change values if any respective magnitude of the initial phase change values for each element is outside of a first range.

19. The method of claim 18, wherein the step of adjusting further includes the steps of:

identifying a predetermined threshold;

determining a largest magnitude phase change from among the initial phase change values; and reducing each of the initial phase change values by multiplying each initial phase change value by the ratio of (the predetermined threshold/the largest magnitude phase change).

20. The method of claim 15, further comprising the step of:

stopping the repeating of steps a)-d) when a predetermined number of iterations is performed.

21. The method of claim 15, further comprising the step of:

stopping the repeating of steps a)-d) when a first solution to the gain pattern equation for a current iteration has a performance that is substantially similar to a performance of a second solution to the gain pattern equation for a previous iteration.

22. A method of synthesizing a beam for a phased array antenna having a plurality of elements, the method comprising the steps of:

a) defining a gain pattern equation for a grid, wherein said grid comprises a plurality of locations receiving the beam of the phased array antenna;

b) linearizing the gain pattern equation into a system of linear equations;

c) characterizing an initial beam pattern by assigning an initial gain value to each location of the grid;

d) identifying a respective gain value for each of a plurality of control locations from among the plurality of locations;

e) in the absence of a pre-computed target, calculating a respective first gain change for each of the identified respective gain values for each of the control locations;

f) solving the system of linear equations using the respective first gain changes to calculate a respective first phase change for each of the elements of the phased array;

g) based on the respective first phase changes for the elements, solve the gain pattern equation to arrive at an incremental gain pattern; and h) repeat steps d)-g) for a plurality of iterations, wherein the respective gain values for the control locations are identified in step d) based on the incremental gain pattern.

23. The method claim 22, further comprising the step of:

adjusting the first phase change calculated for each of the elements.

24. The method of claim 23, wherein an amount of adjusting of the first phase changes is related to an amount of how much a highest magnitude of the first phase changes exceeds a predetermined range.

25. The method of claim 22, where a first set of the control locations are within at least one boost region of the grid and a second set of the control locations are within a sidelobe region of the grid.

26. The method of claim 25, wherein the step of calculating a respective first gain change generates a respective positive value for each control location in the first set and a respective negative value for each location in the second set.

27. The method of claim 26, wherein the respective positive and negative values algebraically sum to substantially zero.

28. The method of claim 22, wherein the respective gain values for each of the plurality of control locations is complex-values having a magnitude and a phase component and wherein the step of calculating a respective first gain change for each of the control locations adjusts each of the magnitude components without substantially adjusting each of the phase components.

29. The method of claim 22, further comprising the step of:

storing the incremental gain pattern.

30. The method of claim 23, further comprising the steps of:

selecting a best performing gain pattern from among the incremental gain patterns and new gain patterns for the plurality of iterations;

calculating respective phase control values for each element of the phased array antenna based on the best performing gain pattern;

and controlling the elements of the phased array antenna in accordance with the calculated respective phase control values.

31. A control system for a phased array antenna comprising a plurality of phase control mechanisms for each of a plurality of elements, the control system comprising:

a memory accessible to one or more processors, said processors in communication with the plurality of phase control mechanisms; and a program resident in the memory configured to be executed by the one or more processors and when executing is further configured to:

solve a gain pattern equation for the phased array antenna for each of a plurality of iterations, wherein for each iteration the following steps are performed:

for a current iteration, determine if a magnitude of an initially calculated phase change for the phased array antenna is within a first range;

adjust the initially calculated phase change for the current iteration to a new phase change value if the magnitude is not within the first range, and use the new phase change value to solve the gain pattern equation for the current iteration;

stop the plurality of iterations when a solution to the gain pattern equation has been reached; and apply, to the plurality of phase control mechanisms, phase values based on the solution.

32. The control system of claim 31, wherein the phased array antenna is spacecraft-based.

33. A program product for controlling a phased array antenna comprising a plurality of phase control mechanisms for each of a plurality of elements, the program product comprising:

a program configured to be executed by one or more processors and when executing is further configured to:

solve a gain pattern equation for the phased array antenna for each of a plurality of iterations, wherein for each iteration the following steps are performed:

for a current iteration, determining if a magnitude of an initially calculated phase change for the phased array antenna is within a first range;

adjusting the initially calculated phase change for the current iteration to a new phase change value if the magnitude is not within the first range, and using the new phase change value to solve the gain pattern equation for the current iteration;

stop the plurality of iterations when a solution to the gain pattern equation has been reached; and apply, to the plurality of phase control mechanisms, phase values based on the solution, and a computer readable media bearing the program.

* * * * *